United States Patent [19]

Hasegawa et al.

[11] Patent Number: 4,674,694

[45] Date of Patent: Jun. 23, 1987

[54] YARN WINDING APPARATUS

[75] Inventors: Katsumi Hasegawa, Kusatsu; Toshio Yasuda; Kouji Shimada, both of Shiga, all of Japan

[73] Assignee: Toray Industries Inc., Tokyo, Japan

[21] Appl. No.: 834,887

[22] Filed: Feb. 28, 1986

Related U.S. Application Data

[63] Continuation-in-part of Ser. No. 530,069, Sep. 7, 1983, abandoned.

[30] Foreign Application Priority Data

Sep. 8, 1982 [JP] Japan ..... 57-155100

[51] Int. Cl.[4] ..... B65H 54/28; B65H 54/38

[52] U.S. Cl. ..... 242/43 R; 242/18.1; 242/43 A; 242/158.3

[58] Field of Search ..... 242/43 R, 43 A, 43.1, 242/43.2, 18.1, 158 R, 158.2, 158.3

[56] References Cited

U.S. PATENT DOCUMENTS

| | | | |
|---|---|---|---|
| 1,957,979 | 5/1934 | Richter | 242/43 R |
| 2,285,439 | 6/1942 | Jones | 242/43 R |
| 2,608,354 | 8/1952 | Whittaker | 242/43 R |
| 3,402,898 | 9/1968 | Mattingly | 242/43 R |
| 3,489,360 | 1/1970 | Torsellini et al. | 242/18.1 X |
| 3,589,631 | 6/1971 | Jennings et al. | 242/43 R X |
| 3,638,872 | 2/1972 | Jennings | 242/18.1 |
| 3,650,486 | 3/1972 | Hasegawa et al. | 242/43 R |
| 3,659,796 | 5/1972 | Bucher et al. | 242/18.1 |
| 3,690,579 | 9/1972 | Porter et al. | 242/43 R |
| 3,718,288 | 2/1973 | Jennings et al. | 242/18.1 X |
| 4,185,790 | 1/1980 | Delerue | 242/18.1 X |
| 4,325,517 | 4/1982 | Schippers et al. | 242/18.1 |

FOREIGN PATENT DOCUMENTS 9386 3/1975 Japan .

*Primary Examiner*—Stanley N. Gilreath

*Attorney, Agent, or Firm*—Birch, Stewart, Kolasch & Birch

[57] ABSTRACT

A yarn winding apparatus having a traverse guide to catch a yarn and traverse it in an axial direction of a bobbin onto which the yarn is taken and a pair of yarn release guides which, located inside of and in the vicinity of both ends of the full traverse stroke Wo corresponding to the full width Wp of a yarn package, can go into or out of the path of the yarn. The traverse guide may be either a cam traverser or a rotary blade traverser. The yarn winding is done by repeating the step of repeatedly traversing the yarn over a full traverse stroke Wo and the step of repeatedly traversing the yarn over a narrow traverse stroke W narrower than the full traverse stroke Wo. In the step of traversing over a narrow traverse stroke W, while the yarn is moving from a mid-stroke position toward one end of the full traverse stroke and before the yarn reaches the one end, the yarn is released from the traverse guide, and then while the released yarn is moving toward the other end of the full traverse stroke, the yarn is again caught by the traverse guide and driven toward the the other end. By this winding, excessive winding at both ends of the yarn package can be eliminated.

18 Claims, 52 Drawing Figures

YARN WINDING APPARATUS

BACKGROUND OF THE INVENTION

1. Field of the Invention

The present application is a continuation-in-part of application Ser. No. 530,069, filed Sept. 7, 1983, now abandoned.

The present invention relates to an apparatus for winding yarn onto a bobbin thereby forming a straight-ended package, and more particularly to an apparatus for forming a straight-ended package without causing the formation of objectionable circumferential end ridges or unevenness of the package.

2. Description of the Prior Art

A yarn, while being traversed by a traversing device, is wound onto a bobbin to form a yarn package. As the conventional devices for traversing a yarn, there exist a cam traverser, a rotary blade traverser, etc. In the cam traverser which is popularly used for low and medium speed operation, a cylindrical cam barrel with a spiral cam groove cut in the roller surface rotates and a traverse guide which holds the yarn slidingly engages the spiral cam groove to produce a reciprocating motion. (Japanese Utility Model Publication No. SHO 50-9386 is an example.) In the rotary blade traverser, the traverse width is divided into plural sections and paired rotary blades are provided at each section. The rotary blades take up the yarn and deliver it from one section to the next. (U.S. Pat. No. 3,650,486 is an example.)

However, the following problem has been encountered in the above-described conventional yarn traversing devices. Namely, the yarn traverse speed drops at both ends of the yarn package and the yarn is wound excessively at both ends of the package for the following reasons: (1) There is an uncontrolled length of yarn between the point at which the yarn is caught by the traverse guide and the point at which the yarn is wound into a package; and (2) especially in the cam traverser, both ends of the cam groove in the cylindrical cam barrel are formed in an arc to facilitate a smooth turnaround of the traverse guide. As a result, both ends of the package surface become convex as compared with the other portion thereof and the yarn taken up there, because they are more strongly pressed by a contacting roller than that of said other portion. Thus, there arises a difference of physical properties between the yarn wound at the mid-portion of the yarn package and the yarn wound at the end portions of the yarn package, resulting in an unevenness of the fabric, knitted work and dyed color.

An attempt to eliminate the excessive and hard winding of yarn at both ends of the yarn package is made in U.S. Pat. No. 3,718,288. The aim of U.S. Pat. No. 3,718,288 lies in changing the reciprocating stroke of the traverse guide which holds and traverses the yarn through a combination of complicated cam mechanisms. However, the device of the complicated cam mechanisms becomes extremely intricate and therefore, it is unfit for the latest high-speed winding (at a rate of 4,000 m/min. or higher) and in any event, such an intricated device would be inevitably expensive.

SUMMARY OF THE INVENTION

A primary object of the present invention is to provide a yarn winding apparatus for winding the yarn in a smooth, uniformly hard straight-ended package without using complex cam mechanisms.

Another object of the present invention is to provide an apparatus for realizing high-speed winding of yarn with the use of a cam traverser.

Still another object of the present invention is to provide an apparatus applicable to high-speed winding of yarn by means of a rotary blade traverser.

Still another object of the present invention is to provide an apparatus for winding the yarn easily applicable to winding by the conventional cam traverser or the conventional rotary blade traverser with partial modifications of these devices.

To attain these objects, the yarn winding apparatus according to the present invention utilizes the characteristics of the yarn such that the yarn, upon being released from the traverse guide, automatically selects its path so that the angle made by the running yarn against the straight line passing both the mid-stroke traversing position and the fulcrum of the traverse may become smaller.

In the present invention, the yarn winding is effected as follows: The yarn continuously delivered through a fulcrum guide of traverse is caught by a traverse guide means and traversed by the traverse guide means in the axial direction of a bobbin and then the yarn is taken onto the bobbin in rotation, thereby forming a yarn package. The yarn winding is effected according to the following steps: (1) the step of repeatedly traversing the yarn over a full traverse stroke Wo corresponding to the full width Wp of the yarn package and winding the yarn into the yarn package and (2) the step of repeatedly traversing the yarn over a narrow traverse stroke W narrower than said full traverse stroke Wo and winding the yarn into the yarn package. The traversing over said narrow stroke W contains the step that while the yarn is moving from a mid-stroke position toward one end of the package and before the yarn reaches said one end of the package, the yarn is released from the traverse guide means, and subsequently, while the yarn thus released is moving toward the other end of the package, the traverse guide means in motion again catches the yarn and drives the yarn toward the other end of the package.

The yarn winding apparatus of the present invention to carry out the above-mentioned yarn winding comprises a fulcrum guide of traverse, a rotatable yarn winding bobbin, a drive means to rotate said bobbin, a traverse guide means located on the path of a yarn catching and making the yarn reciprocate in the axial direction of said yarn winding bobbin and a drive means for driving said traverse guide means.

The yarn winding apparatus further comprises:

(a) a pair of yarn release guides which are located inside of, and near both ends of a full traverse stroke Wo corresponding to the full width Wp of a yarn package and which can move into and out of the traversing path of the yarn traversed by said traverse guide means, thereby releasing the yarn from said traverse guide means; and (b) a drive means for making said yarn release guide move into and out of the yarn path. In the above mentioned apparatus, the traverse guide means may be either a cam traverser or a rotary blade traverser.

In the apparatus with the above composition, the yarn will be wound onto the bobbin to a narrow width, while the yarn release guide is at work and the yarn is off the traverse guide means. Thus formation of end ridges or unevenness at both ends of the yarn package can be eliminated by repeatedly getting the yarn off the traverse guide means during the package formation period.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, in which.

DETAILED DESCRIPTION OF THE PREFERRED EMBODIMENTS

Figure 1:
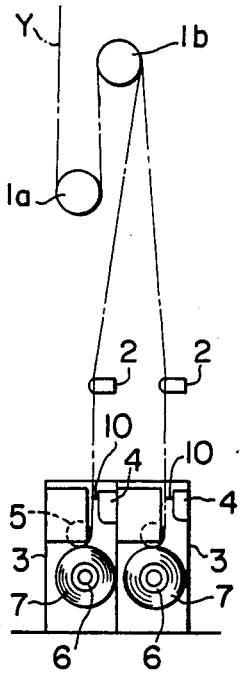
FIG. 1 is a schematic diagram showing the layout of yarn winding apparatus of the present invention as viewed along a yarn running path.
Figure 2:
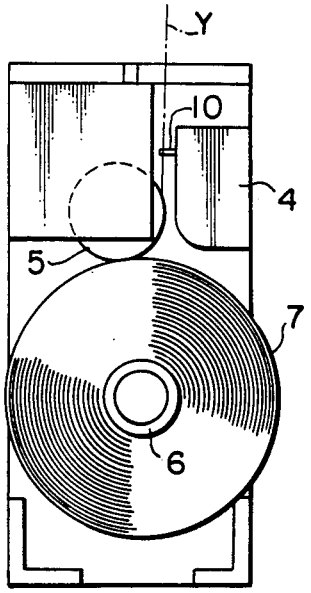
FIG. 2 is a front view of a cam traverser and the vicinity thereof.
Figure 3:
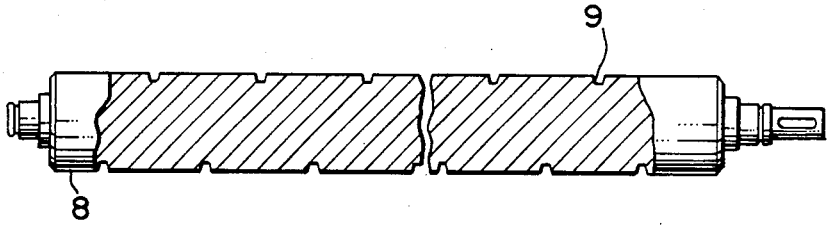
FIG. 3 is a partial fragmentary front view of a cylindrical cam barrel.

FIGS. 1 to 13 and FIGS. 20 to 21D show a yarn winding apparatus equipped with a cam traverser as a first embodiment of the present invention. As seen in FIG. 1, yarn Y is drawn out by draw rollers 1*a*, 1*b* and it passes a fulcrum traverse guide 2, 2 and is taken up onto a bobbin 6 of a winding machine 3. In the process of winding, the yarn Y is traversed by a traverser 4 which is located on the path of the yarn Y as indicated in FIG. 2 and the yarn Y thus traversed is wound onto the bobbin 6 by the surface driving of a friction roller 5, thereby forming a straight-ended package 7.

The yarn Y is traversed through the reciprocating movement of a traverse guide 10 in the axial direction of the bobbin 6. The reciprocation of the traverse guide 10 is effected by a traverse guide drive means consisting of a cam barrel 8. For this purpose, a cam groove 9 is formed in the surface of the cylindrical cam barrel 8 (see FIG. 3) and an engaging part 12 of the traverse guide 10 shown in FIG. 4A slidably engages with said cam groove 9.

Figure 5:
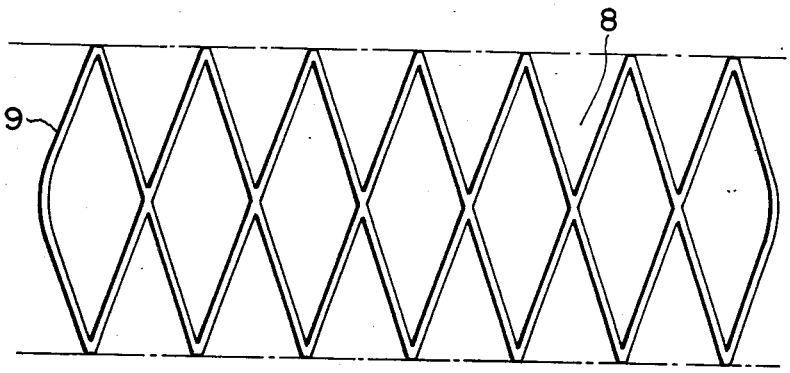
FIG. 5 is a developed view of a cam groove in the surface of a cylindrical cam barrel of FIG. 3.

The rotation of the cylindrical cam barrel 8 causes the traverse guide 10 to run in the axial direction of the cylindrical cam barrel 8 guided by a linear guide (not shown) and the cam groove 9. As shown in FIG. 5, the cam groove 9 is spirally cut in the surface of the cylindrical cam barrel 8 and the cam groove 9 is formed in a smooth arc at the both ends of the cylindrical cam barrel 8 so that the shock on the traverse guide 10 as it turns around may be mitigated.

Figure 4A:
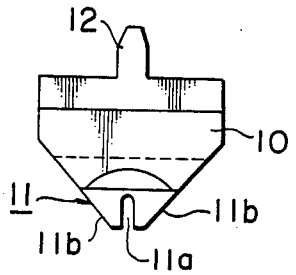
FIG. 4A is a plan view of a traverse guide.
Figure 4B:
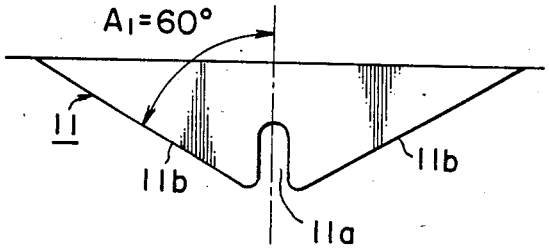
FIG. 4B is a plan view of a traverse guide having slopes inclined at the angle of 60°.
Figure 4C:
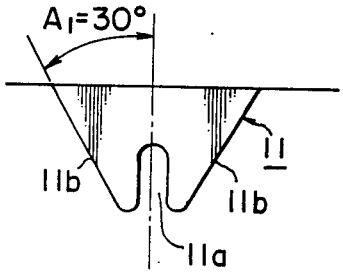
FIG. 4C is a plan view of a traverse guide having slopes inclined at the angle of 30°.

As indicated in FIGS. 4A, 4B and 4C, the traverse guide 10 is provided with a yarn catcher 11 which has a groove 11*a* for holding and releasing the yarn Y. The groove 11*a* opens toward the friction roller 5 and therefore the yarn Y can get out of the groove 11*a* when the yarn Y is pushed toward the friction roller 5. The yarn catcher 11 has slopes 11*b*, 11*b* which are gently inclined and are symmetrically provided on both sides of the groove 11*a* so that the yarn Y, when pushed from both sides toward the groove 11*a*, will go into said groove 11*a*. The angle A1 made by the slope 11*b* and the center line of the traverse guide 10, namely the center line of the groove 11*a*, is in the range of 30°-60° as shown in FIG. 4B and 4C and desirably is in the range of 42°-48° so that the yarn Y may easily and smoothly go into the groove 11*a* and a compact traverse guide may be obtained. After the yarn Y reaches the groove 11*a*, the yarn Y is guided and traversed by the traverse guide 10.

Figure 6A:
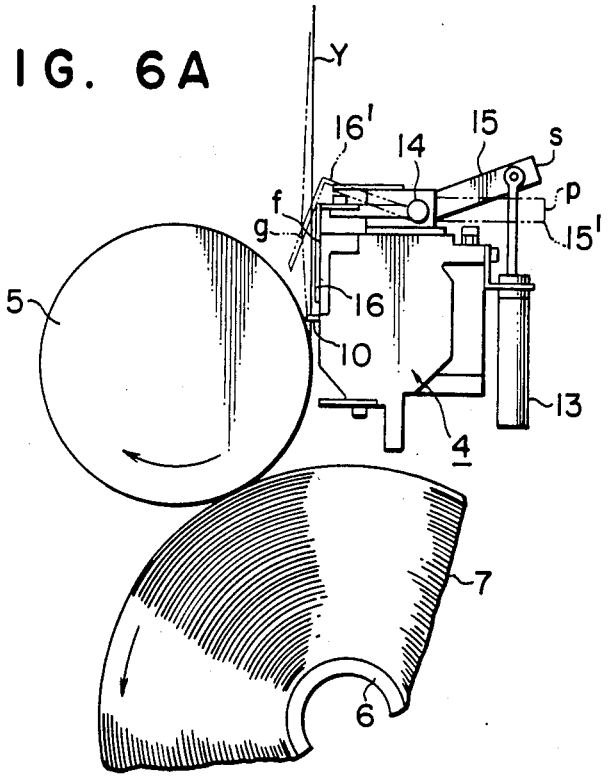
FIG. 6A is an enlarged view of the cam traverser utilizing a cylinder and the vicinity thereof in FIG. 2.
Figure 6B:
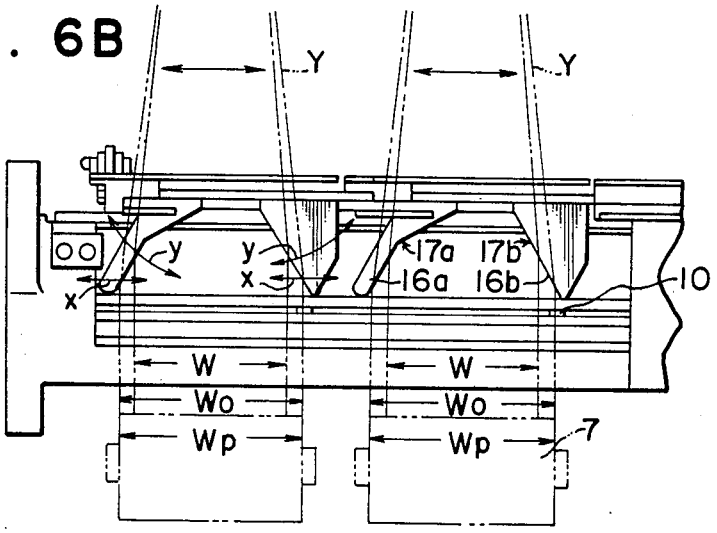
FIG. 6B is a front view of the cam traverser of FIG. 6A.

FIG. 6A and 6B are enlarged views of the traverser 4 and the vicinity thereof. Next to the traverser 4 stands a cylinder 13 which constitutes the yarn release guide drive means. A rod of the cylinder 13 is rotatably linked to one end of a lever 15 which can swing around a shaft 14 attached to the top of the traverser 4.

At the opposite end of the lever 15 is located a yarn release guide 16 which can swing around the shaft 14 together with the lever 15.

A pair of yarn release guides 16*a*, 16*b* are located inside of both ends of the full traverse stroke Wo of the yarn and near the both ends of the full traverse stroke Wo. The yarn release guides 16*a*, 16*b*, swinging together with the lever 15, can get into and out of a path of the yarn Y. The action of the cylinder 13 causes the yarn release guides 16*a*, 16*b* to come to a solid line position f of FIG. 6A where it does not interfere with the yarn Y being traversed, when the lever 15 is at its solid line position s of FIG. 6A. The action of the cylinder 13 causes the yarn release guides 16*a*, 16*b* to come to a two-dot chain line position g where it interferes with the yarn Y, when the lever 15 is at a two-dot chain line position p. The opposed sides 17*a*, 17*b* of the yarn release guides 16*a*, 16*b* jut out toward the friction roller 5 and serve to push the yarn Y off the traverse guide 10.

In the apparatus illustrated in FIGS. 6A and 6B, the yarn release guides 16*a*, 16*b* are linked to a single shaft 14, and they can simultaneously get into or out of the yarn path. The arrangement may be designed differently; namely each of the yarn release guides 16*a*, 16*b* may be provided with a cylinder 13 so that they can be independently driven.

A drive means for moving the yarn release guides 16*a*, 16*b* will be explained, in detail with reference to FIGS. 7A to 7D. A pneumatic solenoid valve 40 is provided in an air-circuit 39 including a path 45 connected to the cylinder 13 at one side of a piston 38 and another path 46 connected to the cylinder 13 at the other side of the piston 38. The pneumatic solenoid valve 40 is provided in the air-circuit 39 between the cylinder and an air source 44. The pneumatic solenoid valve 40 has a parallel path portion 42 which connects the path 45 to the air source 44 and connects the path 46 to the environment, and the valve 40 also has a cross path portion 41 which is able to connect the path 46 to the air source 44 and to connect the path 45 to the environment. The valve 40 has a solenoid 43 which switches the valve 40 between the portion 41 and the portion 42. An electric controller 48 is electrically connected to the solenoid 43 of the pneumatic solenoid valve 40 and the switching between ON and OFF of the electric controller 48 switches the solenoid 43 between ON and OFF. A time of ON (T1) and a time of OFF (T2) are predetermined and the times T1 and T2 are adjustable.

Figure 7A:
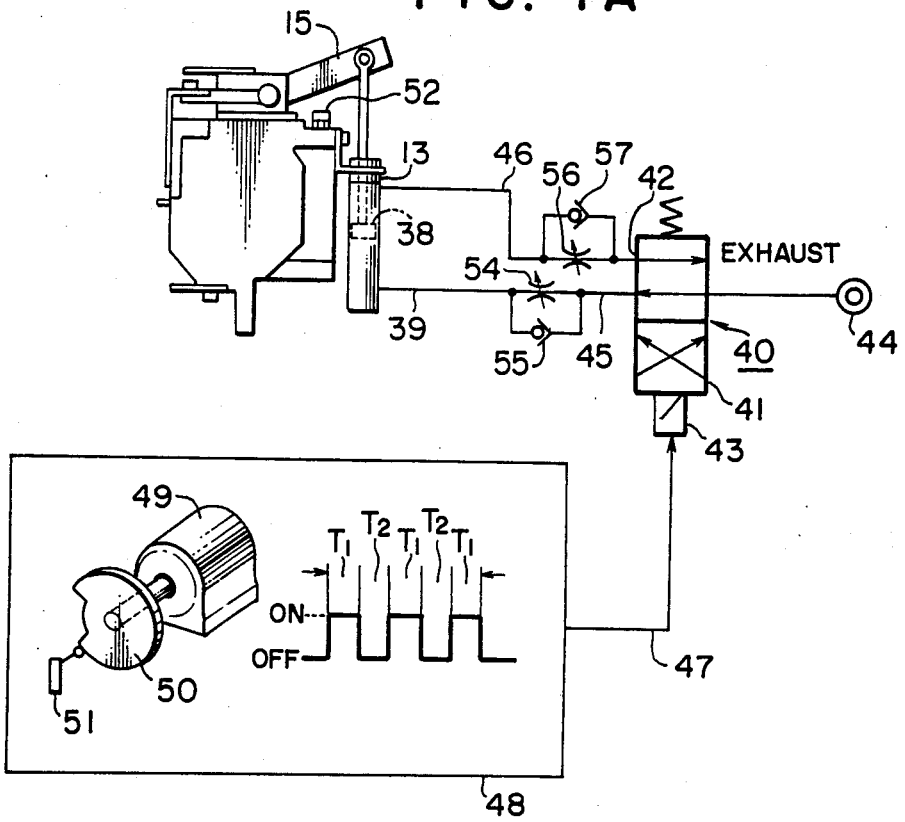
FIG. 7A is a schematic diagram of a drive means for moving the yarn release guide.
Figure 21A:
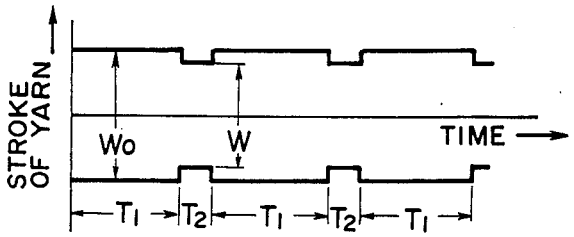
FIGS. 21A, 21B, 21C and 21D are diagrams illustrating the relationship between time and traversing stroke.
Figure 21B:
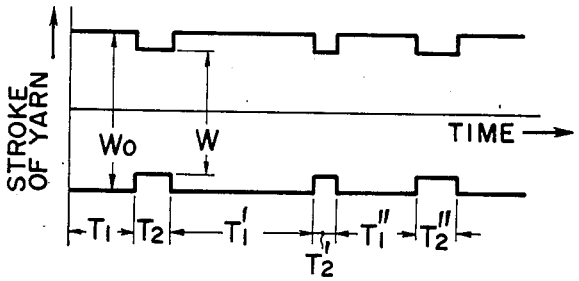
Figure 21C:
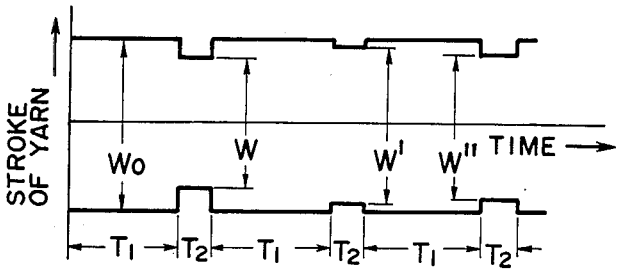
Figure 21D:
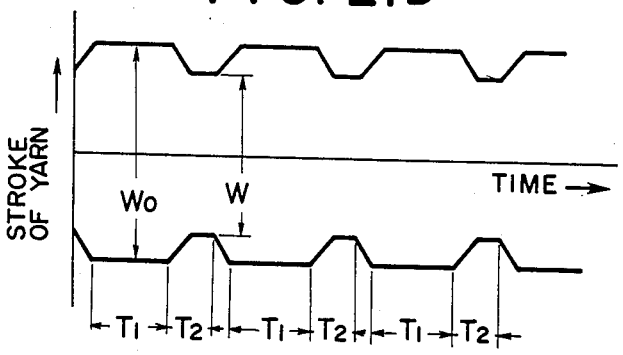

One example of the time adjusting mechanism is shown in the block of the electric controller 48 of FIG. 7A. In the example, a cam 50 is rotated at a constant speed by a cam-drive motor 49. A limit switch 51 is provided so that the cam 50 contacts the limit switch 51 and holds the limit switch 51 in ON when a large diameter portion of the cam 50 comes to the limit switch 51, while the cam 50 disengages the limit switch 51 and holds the limit switch 51 in OFF when a small diameter portion of the cam 50 comes to the limit switch 51. The times of ON and OFF of the limit switch 51 are adjustable through the adjustment of the ratio of the large diameter portion and the small diameter portion of the cam 50 and through the adjustment of the rotation speed of the cam-drive motor 49. Thus, the time T1 of the full traverse stroke of the yarn and the time T2 of the narrow traverse stroke of the yarn shown in FIGS. 21A, 21C and 21D are controlled. When the times T1 and T2 are required to be changed in various cycles, the requirement will be easily satisfied through selecting an appropriate shape of the cam 50, as shown in a cam 50*a* of FIG. 7B. The time of ON (T1) and the time of OFF (T2) may be controlled by a timer on the market.

At the vicinity of one end of the swing motion of the lever 15, there is provided a stopper 52 for determining one end position of the stroke of the cylinder 13, thereby determining the swing angle of the yarn release guides 16*a* and 16*b* and determining the narrow traverse stroke W of the yarn. Since the stopper 52 is screw-engaged with the fixed means consisting of a nut, the position of the stopper 52 is adjustable. However, once upon being set, the position of the stopper 52 is unvariable during the operation of the winding device. The full traverse stroke Wo of the yarn of FIGS. 21A, 21B and 21D is determined by the other stroke end of the cylinder 13. By the above mechanism, the pattern including the constant narrow traverse stroke W and the full traverse stroke Wo of FIGS. 21A, 21B and 21D can be obtained. As mentioned above, the narrow traverse stroke W can be adjusted. When the narrow traverse stroke W is required to be variously changed during the operation of the winding device, a stopper 52*a* having various heights is used and the stopper 52*a* is rotated by a stopper drive motor 53 at a constant speed, as shown in FIG. 7C. Thus, the swing angle of the yarn release guides 16*a* and 16*b* is variously changed and the pattern of FIG. 21D can be obtained.

Figure 7B:
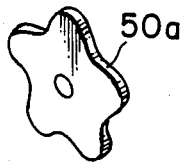
FIG. 7B is an oblique view of a cam which may be used in the drive means of FIG. 7A.
Figure 7C:
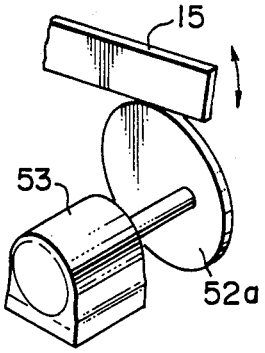
FIG. 7C is an oblique view of a stopper which may be used in the drive means of FIG. 7A.
Figure 7D:
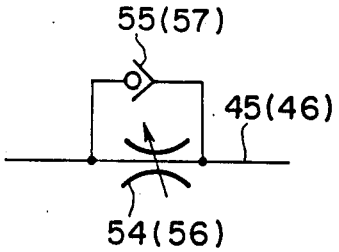
FIG. 7D is a partial schematic diagram of a throttle which may be used in the drive means of FIG. 7A.

In the paths 45 and 46 of the air-circuit 39 connected to the cylinder 13, variable throttles 54 and 56 may be provided together with by-paths provided with check valves 55 and 57 as shown in FIG. 7A or FIG. 7B. Such throttles 54 and 56 can control the flow speed, that is, the speed of the reciprocating motion of the cylinder. Thus, the pattern having a slope portion between the full traverse stroke Wo and the narrow traverse stroke W shown in FIG. 21D can be obtained.

In the construction as illustrated in FIG. 6A, the yarn release guides 16*a*, 16*b* can get into or out of the yarn path in a direction normal to the yarn traverse direction. Otherwise, it may be so arranged as indicated by arrows x, y in the left half of FIG. 6B where they can get into or out of the yarn path in the yarn traverse direction. The arrow x shows the movement of a yarn release guide in the case where the yarn release guide reciprocates in the yarn traverse direction and the arrow y shows the movement of a yarn release guide in the case where the yarn release guide swings in the yarn traverse direction.

Figure 8A:
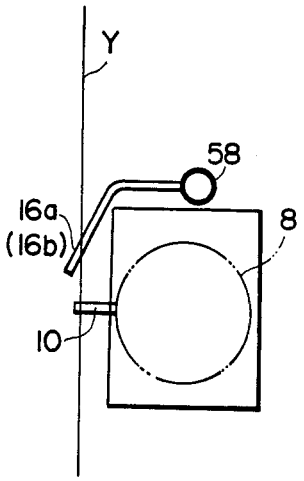
FIG. 8A is a side view of yarn release guides which move in a yarn traverse direction.
Figure 8B:
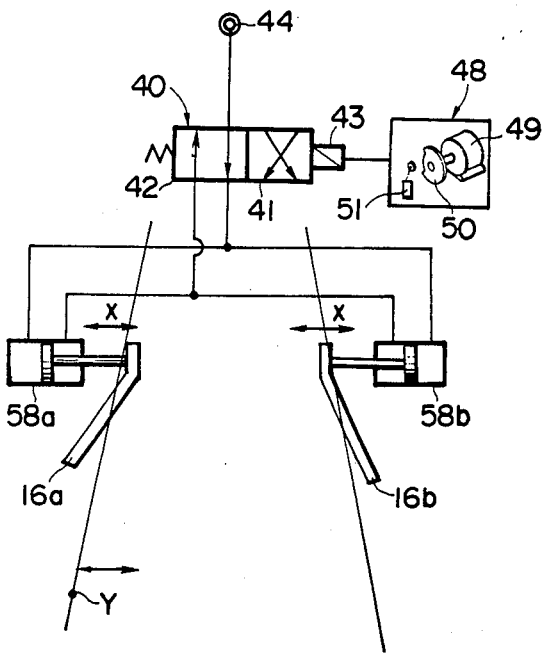
FIG. 8B is a schematic diagram of a drive means for moving the yarn release guides of FIG. 8A.

FIGS. 8A and 8B show a drive means for moving the yarn release guides 16*a* and 16*b*, in which the yarn release guides 16*a* and 16*b* are drived in the yarn traverse direction. The rods connected to pistons in the cylinders 58*a* and 58*b* are coupled with the yarn release guides 16*a* and 16*b* respectively and reciprocally drive the yarn release guides 16*a* and 16*b* in the yarn traverse direction in accordance with the movement of the pistons in the cylinders 58*a* and 58*b*. The yarn release guides 16*a* and 16*b* extend downward in a inclined manner and cross the plane containing the yarn path so that the lower portions of the yarn release guides 16*a* and 16*b* come into the side of the friction roller 5. The means for operating cylinders 58*a* and 58*b* are the same as those of FIGS. 7A to 7D. Therefore, the explanation about the same parts will be omitted by attaching the same reference numerals to the same parts of FIGS. 8A and 8B as those of FIGS. 7A to 7D.

Figure 10A:
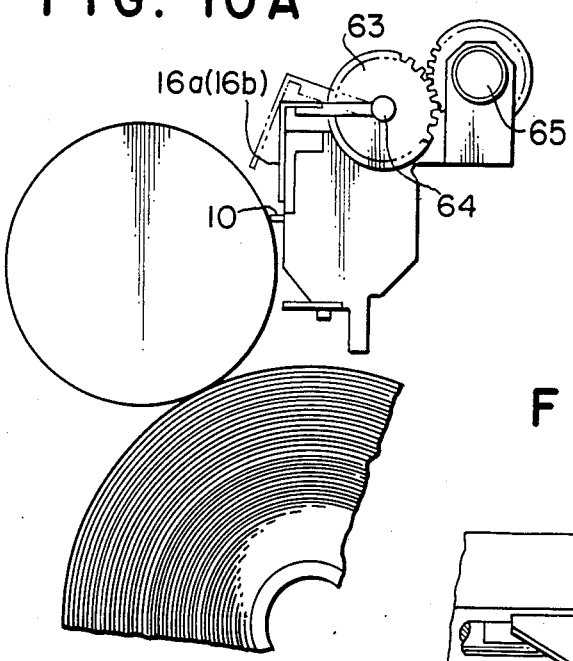
FIG. 10A is a side view of a cam traverser utilizing a motor.
Figure 10C:
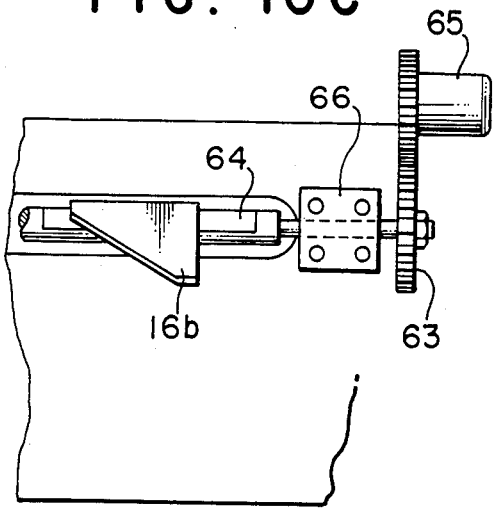
FIG. 10C is an enlarged plan view of the cam traverser of FIG. 10B.
Figure 10B:
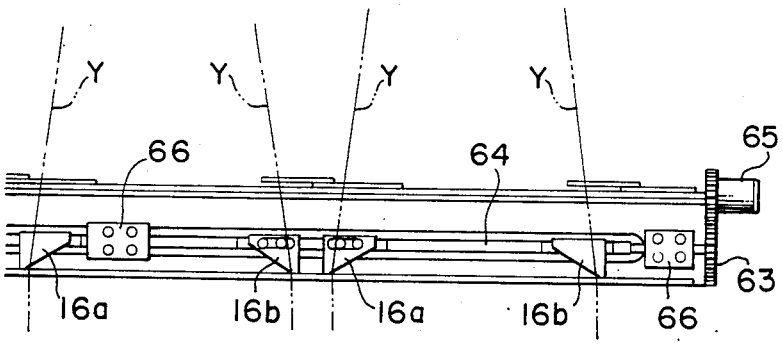
FIG. 10B is a plan view of the cam traverser of FIG. 10A.
Figure 10D:
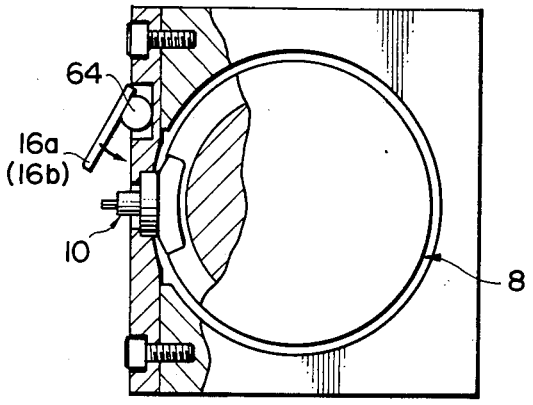
FIG. 10D is an enlarged side view of the cam traverser of FIG. 10C.
Figure 10E:
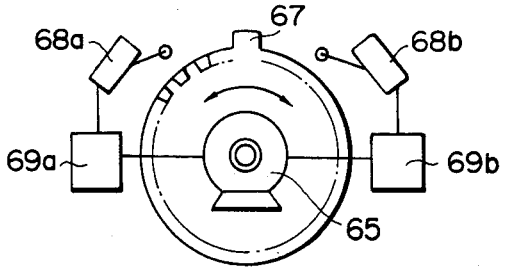
FIG. 10E is a stopper used in the cam traverser of FIG. 10A.
Figure 10F:
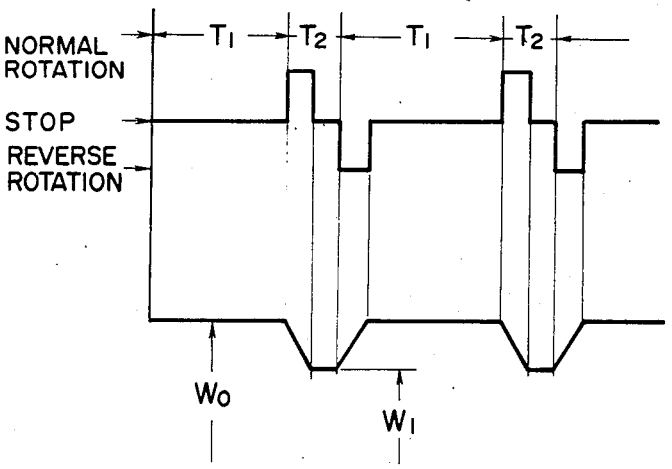
FIG. 10F is a diagram showing the operation of the cam traverser of FIG. 10A.

Each above-mentioned drive means for moving the yarn release guides includes a cylinder system. However, a drive means which includes an electric motor may be used. FIGS. 10A to 10F show the drive means for moving the yarn release guides 16*a* and 16*b*, which utilizes an electric motor. The yarn release guides 16*a* and 16*b* are fixed to a rotatable shaft 64 which is rotatably supported by a bearing 66. A gear 63 is fixed to one end of the shaft 64 and the gear 63 is meshed with a gear which is coupled with a shaft of the drive motor 65. The normal or reverse rotation of the motor 65 drives the yarn release guides 16*a* and 16*b* to swing in the direction normal to the yarn traverse direction. As shown in FIG. 10E, a protrusion 67 is provided at the periphery of the gear provided with the drive shaft of the drive motor 65 or the gear 63 and a pair of limit switches 68*a* and 68*b* are arranged at both sides of the protrusion 67 in the rotational direction of the gear. When the protrusion 67 hits the limit switches 68*a* and 68*b*, the rotation of the motor 65 is stopped by a specified period T1 or T2 determined by timers 69*a* and 69*b*. After the specified period T1 or T2, the motor 65 starts to rotate in the direction opposite to the previous direction. Since the limit switches 68*a* and 68*b* stop the rotation of the motor 65 when they are contacted, the limit switches 68*a* and 68*b* constitute a stopper. Through the adjustment of the position of the limit switches 68*a* and 68*b*, the narrow traverse stroke W of the yarn and the full traverse stroke Wo of the yarn can be adjusted. Also, through the setting of the specified time of the timers 69*a* and 69*b*, the period T1 of the full traverse stroke of the yarn and the period T2 of the narrow traverse stroke of the yarn can be adjusted. Further, the adjustment of the rotation speed of the motor 65 can control the slope portion of the pattern between the full traverse stroke of the yarn and the narrow traverse stroke of the yarn, as shown in FIG. 10F.

Figure 9A:
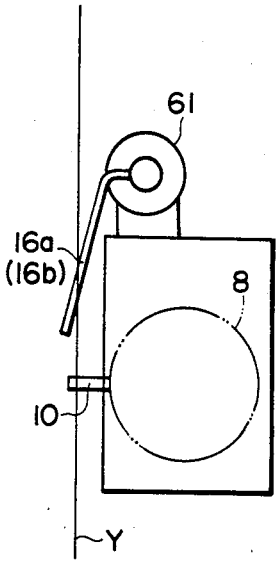
FIG. 9A is a side view of yarn release guides which swing in a yarn traverse direction.
Figure 9B:
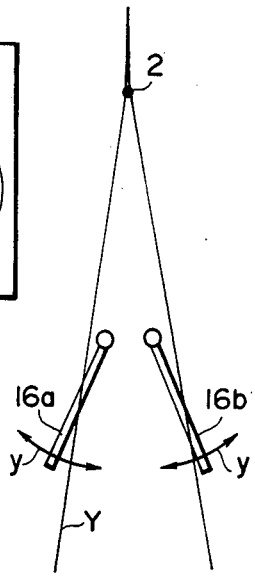
FIG. 9B is a front view of the yarn release guides of FIG. 9A.
Figure 9C:
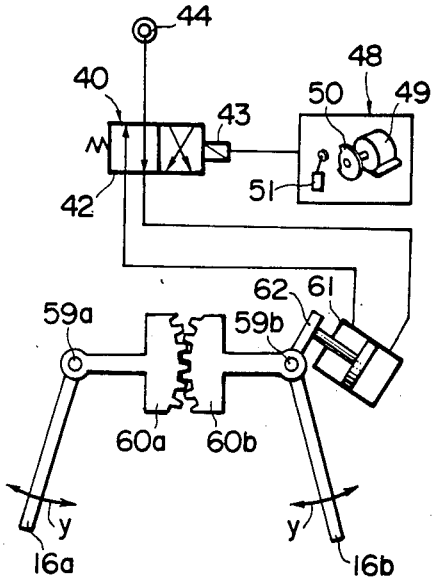
FIG. 9C is schematic diagram of a drive means for moving the yarn release guides of FIG. 9A.

FIGS. 9A to 9C show a drive means for moving the yarn release guides 16*a* and 16*b*, in which the yarn release guides 16*a* and 16*b* swing in the yarn traverse direction. Partial gears 60*a* and 60*b* are coupled with the yarn release guides 16*a* and 16*b* and the gears 60*a* and 60*b* are rotatably supported by shafts 59*a* and 59*b*. The gears 60*a* and 60*b* engage to each other, and when one of the gears 60*a* and 60*b* rotates in the clockwise direction, the other gear rotates in the anti-clockwise direction. An arm 62 is connected to one gear 60*b* and the arm 62 is pushed or pulled by an arm drive cylinder 61. The yarn release guides 16*a* and 16*b* extend downward in an inclined manner and cross the plane containing the yarn path so that the lower portion of the yarn release guides 16*a* and 16*b* come into the side of the friction roller 5. When the cylinder 61 operates, the yarn release guides 16*a* and 16*b* swing in the opposite direction to each other. The means for operating cylinder 61 are the same as those of FIGS. 7A to 7D. Therefore, the explanation about the same parts will be omitted by attaching the same reference numerals to the same parts of FIGS. 9A to 9C as those of FIGS. 7A to 7D.

According to the first embodiment of the present invention, the yarn is wound as follows:

The yarn Y, as shown in FIG. 1, is continuously delivered through the fulcrum guide 2 of traverse and, being traversed in the axial direction of the bobbin 6 by the traverse guide 10 which constitutes the yarn traverse guide means, is taken onto a rotating bobbin 6. In the course of winding, the yarn release guide 16 can take two positions, i.e., a solid line position f or a two-dot chain line position g of FIG. 6A.

At the position f of FIG. 6A, the yarn release guides 16*a*, 16*b* do not interfere with the yarn Y and the yarn Y is traversed with a full traverse stroke Wo corresponding to the full package width Wp, namely with a normal traverse stroke.

Figure 11A:
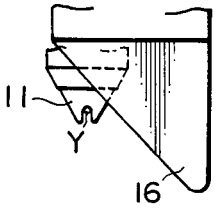
FIGS. 11A, 11B and 11C are partial plan views of a yarn release guide and the traverse guide showing the steps of the release of the yarn.
Figure 11B:
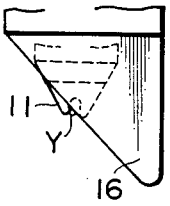
Figure 11C:
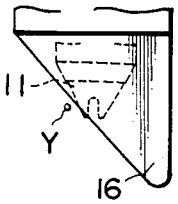
Figures 11D, 11E, 11F, 11G:
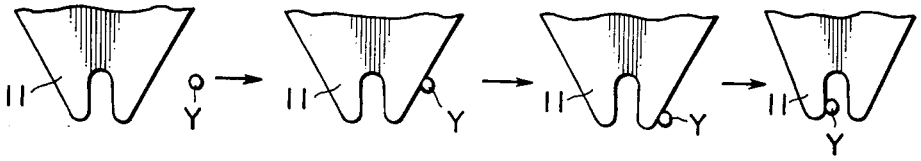
FIGS. 11D, 11E, 11F and 11G are partial plan views of the traverse guide.
Figure 11H:
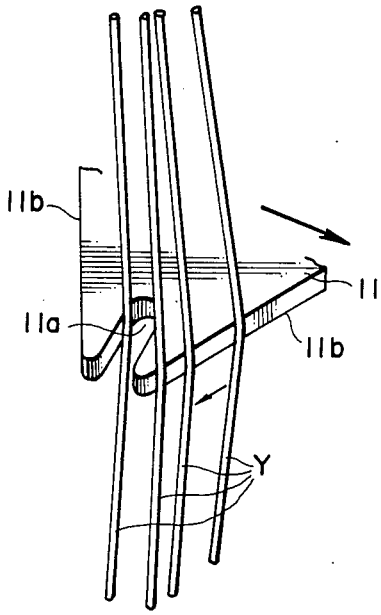
FIG. 11H is a partial oblique view of the traverse guide showing the steps of catching the yarn.

When the cylinder 13 brings the lever 15 down to the two-dot chain line position p in FIG. 6A, the yarn release guides 16*a*, 16*b* are swung to the two-dot chain line position g. In the condition, the yarn Y and the yarn release guides 16*a*, 16*b* come to engage with each other. As a result, as shown in FIGS. 11A, 11B and 11C, the yarn Y is pushed by the push edges 17*a*, 17*b* ( FIG. 6B ) of the yarn release guides 16*a*, 16*b* toward the friction roller 5 and as a consequence, the yarn Y comes off the groove 11*a* of the yarn catcher 11.

Immediately after coming off the traverse guide 10, the yarn Y turns around and begins to move toward the mid-width of the package 7 as the winding progresses so that the angle Ao may become smaller. The angle Ao ( FIG. 20 ) is an angle made by a line linking the fulcrum guide of traverse 2 and the winding contact point 31 in FIG. 20 against a perpendicular line drawn from the fulcrum guide of traverse 2 to the axis of the bobbin 6. The traverse guide 10 is still on the way to a turnaround point and it is, unlike the yarn Y, moving toward the yarn package end. Meanwhile the yarn Y, released from the traverse guide 10, has the angle Ao gradually diminished and, as the mid-width of the package is approached, the traverse speed of the yarn Y drops. On the other hand, the traverse guide 10 turns around at a turnaround point over the package end and runs after the yarn Y. The traverse guide 10, moving at a constant speed, catches up with the yarn Y on the way, and, catching the yarn Y in the yarn catcher 11 as shown in FIGS. 11D, 11E, 11F, 11G and 11H, moves on in the direction of the other turnaround point. Near the other end of the package, similar interference between the yarn Y and the release guide 16 takes place and by a similar action to the above, the yarn Y comes off the traverse guide 10. Then, the yarn Y starts on a return trip to the mid-width of package 7, while the traverse guide 10, turning around at the other turnaround point over the package end, again catches the yarn Y. The traverse stroke W of the yarn Y as it is off the traverse guide 10 is smaller than the full traverse stroke Wo and as a consequence the lesser diameter portion of mid-package so far wound up comes to be covered up with the yarn Y which is now being traversed with a narrow traverse stroke W.

Thus by alternation of the time T1 in which the yarn Y, held by the traverse guide 10, is repeatedly traversed over the full traverse stroke Wo corresponding to the full width Wp of the yarn package 7 and the time T2 in which the yarn Y, released from the traverse guide 10 at the vicinity of the traverse end, is repeatedly traversed over a traverse stroke W narrower than the full traverse stroke Wo, and by appropriate setting of the releasing point by the yarn release guides **16*a*, 16*b* against the turn around position of the traverse guide 10, the formation of convex portion due to excessive winding of the yarn at both ends of the package 7 can be prevented and the surface hardness of the package 7** can be made uniform.

FIGS. 21A, 21B, 21C and 21D are diagrams showing the alternation of the time T1 of traversing with a full traverse stroke Wo and the time T2 of traversing with a narrow traverse stroke W. FIG. 21A illustrates the case where T1 and T2 are respectively constant and are regularly alternated. FIG. 21B illustrates the case where T1 and T2 are varied and are irregularly alternated. Alternation may be either the pattern of FIGS. 21A, 21C and 21D or the pattern of FIG. 21B.

The ratio of the sum of every time T1 during the package formation period to the sum of every time T2 during the package formation period is desirably 3 or larger since if it is less than 3, both ends of the package will become too flabby. Further, the ratio is desirably 30 or smaller since if it is more than 30, the effect of winding with the narrow traverse stroke W will be almost zero. The value of the ratio of the sum of every time T1 to the sum of every time T2 during the package formation period is desirably in the range of between 8 and 20 from the standpoint of especially good hardness distribution.

Figure 12A:
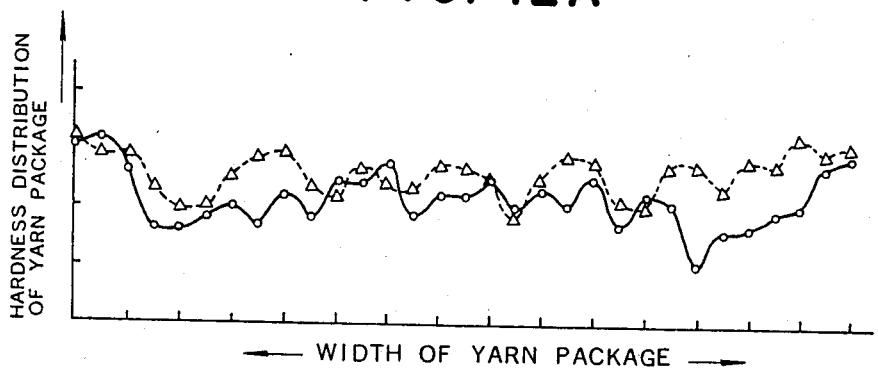
FIG. 12A shows a hardness distribution of a yarn package when the yarn is traversed both with a full traverse stroke and with a narrow traverse stroke.
Figure 12B:
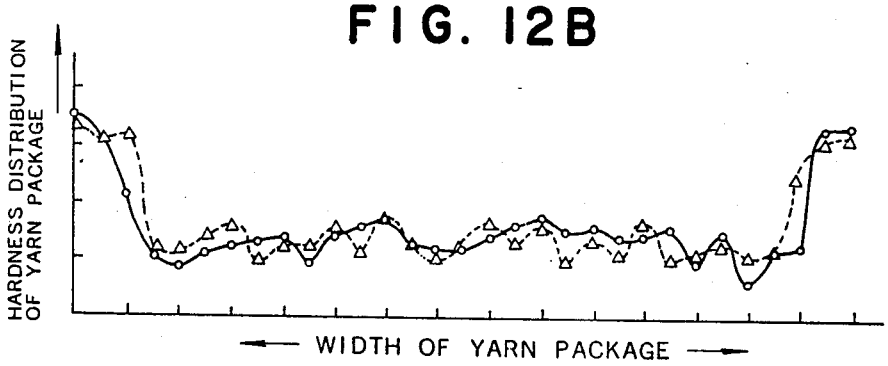
FIG. 12B shows a hardness distribution of a yarn package when the yarn is traversed only with a full traverse stroke.

FIG. 12A shows the surface hardness distribution of the yarn package 7 when the ratio of the sum of every time T1 to the sum of every time T2 is set at 12, while FIG. 12B shows the surface hardness distribution of the yarn package 7 when the ratio is set very large, namely that obtained using the conventional device with no yarn release guide 16. The kind of yarn used in the test was PET-POY 150D (polyethylene terephthalate-partially oriented yarn; 150 denier) and the condition of winding was as follows:

Yarn running speed: 3,000 m/min
Number of traversing: 1,000 cpm
Width of winding: 150 mm From FIGS. 12A and 12B, it is understood how the convex portions at both ends of the yarn package 7 have been substantially eliminated and how uniform the surface hardness including both ends can be made. In FIGS. 12A and 12B the solid line and the broken line respectively represent the left and right packages in FIG. 6B.

Figure 13:
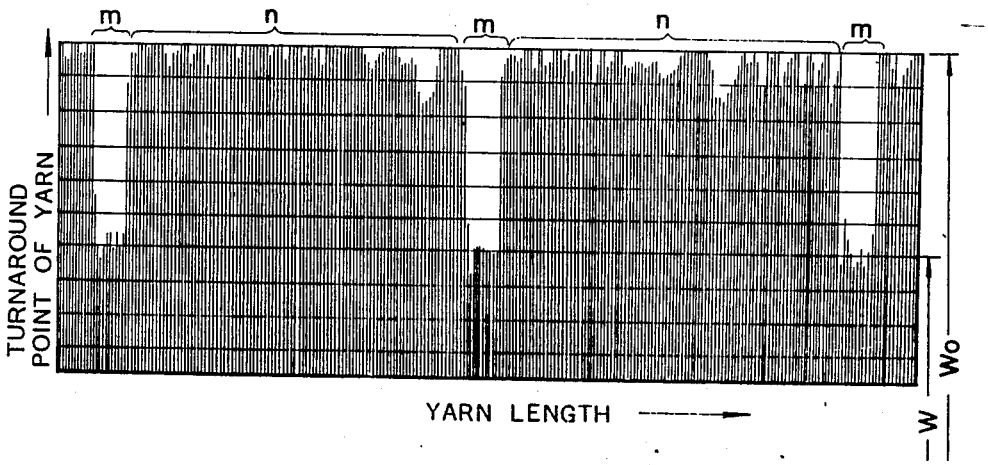
FIG. 13 is a chart showing the state of the yarn turning around at the end of a wound up yarn package.

FIG. 13 is a chart showing the measured position of the yarn turnaround in a yarn package obtained when the ratio of the sum of every time T1 during the package formation period to the sum of every time T2 during the package formation period is set at 11. In the figure, the area marked (m) is a region of narrow traverse stroke W while the area marked (n) is a region of full traverse stroke Wo. It is seen that the full traverse stroke Wo and the narrow traverse stroke W conform to the set conditions.

FIG. 13 shows a case of the narrow traverse stroke W being constant during the package formation period. However, the present invention covers both the case where the narrow traverse stroke W is constant and the case where W is variable during the package formation, as illustrated in FIG. 21C.

The above-mentioned elimination of excessive winding of yarn at both ends of the yarn package 7 will be more significant as the traverse speed is faster. The high-speed performance of the conventional cam traverser depends on the impact value at turnaround. To obtain a high-quality package with a neat-wound appearance, the turnaround should be sharp. However, a sharp turnaround would easily bring the acceleration at turnaround to over 1,000 G (1 G=gravitation acceleration of the Earth) and this would easily break the traverse guide. For this reason, the adoption of high speed has been avoided. On the contrary, if the impact at turnaround is abated to make the turnaround smooth, the yarn will be excessively wound at both ends of the package, yielding a package of poor quality. In the present example of the embodiment, even when a traverse guide drive means 8 so constituted as to assure smooth turnaround at the ends, as illustrated in FIG. 5, is employed, a high-quality package having a neat-wound appearance can be produced by setting an appropriate ratio of the full traverse stroke to the narrow traverse stroke and covering the central recess with the narrow traverse stroke. This will make it possible to adopt a cam profile which assures a smooth turnaround, hence to make high-speed winding with the use of a cam traverser.

Next, a description is made of a yarn winding apparatus using a rotary blade traverser as a second embodiment of the present invention. FIGS. 14 to 19B and FIGS. 20 and 21D illustrate the second embodiment. The embodiment is applicable to a rotary blade traverser such as disclosed in U.S. Pat. No. 3,650,486.

Figure 14:
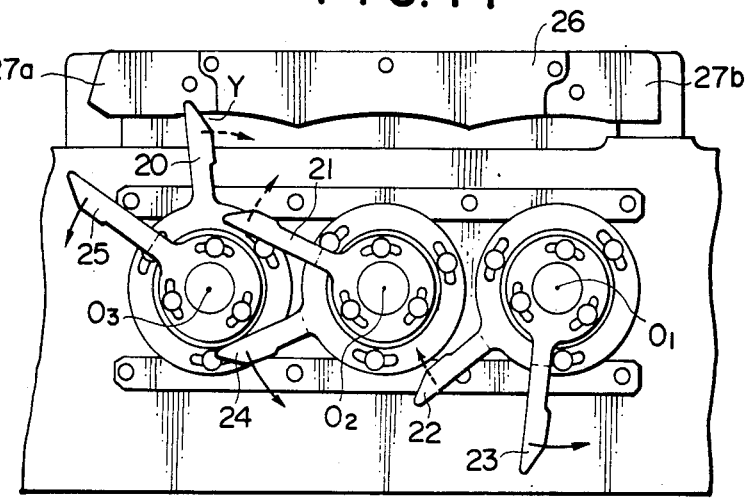
FIG. 14 is a plan view of a rotary blade traverser.
Figure 15A:
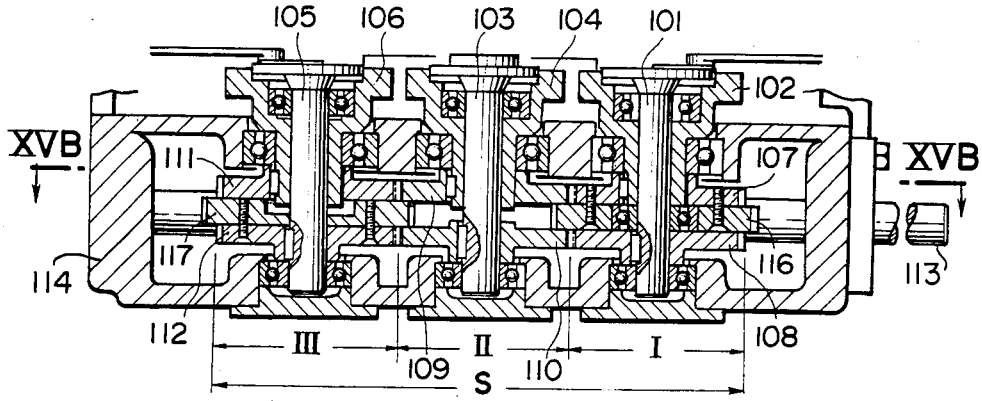
FIG. 15A is a sectional view of the rotary blade traverser of FIG. 14.

As shown in FIG. 14, on centers $O_1$, $O_2$ and $O_3$ of virtual hexagons having respective groups widths I, II and III as their one side S, pairs of shafts 101 and 102, 103 and 104, 105 and 106 are coaxially and rotatably disposed. A mechanism for rotatably actuating the shafts 101 to 106 is shown in FIG. 15A in detail. The shafts 101, 103 and 105 are provided with gear wheels 108, 110 and 112 respectively secured thereto in a mutually meshing arrangement. On the other hand, shafts 102, 104 and 106 are also provided with gear wheels 107, 109 and 111 respectively secured thereto in a mutually meshing arrangement. All of the gear wheels 107 to 112 are provided with the same number of gear teeth. The centers $O_1$, $O_2$ and $O_3$ lie in a common plane.

Figure 15B:
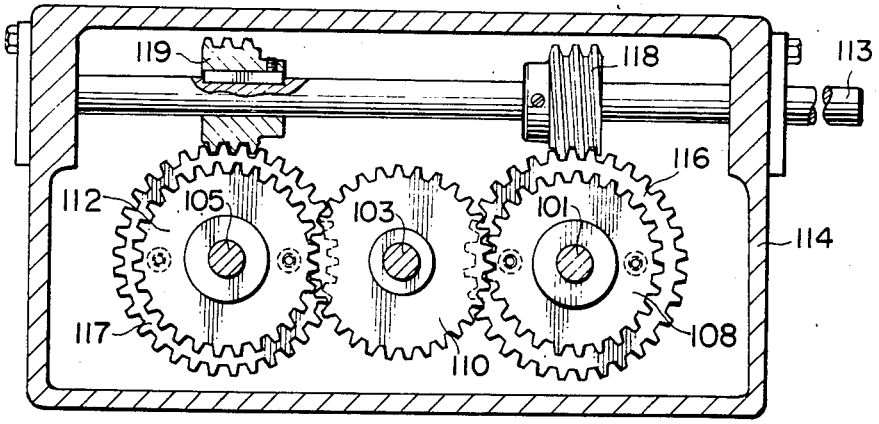
FIG. 15B is a sectional view taken along a line XVB—XVB of FIG. 15A.

A mechanism for rotatably actuating the gear wheels 107 to 112 is illustrated in FIG. 15B, wherein a driving shaft 113 is disposed within the gear casing 114 in a direction substantially perpendicular to the axial directions of the parallelly arranged shafts 101, 103 and 105.

Being sandwiched by the gear wheels 107 and 108, 111 and 112, two additional gear wheels 116 and 117 are fixedly related to the shafts 101 and 106 by way of the gear wheels 108 and 111 as is clearly shown in FIG. 15B. For the purpose of ensuring smooth rotation of all the above-described shafts in the gear casing 114, bearings of an ordinary type are disposed adequately as shown in the drawing. On the driving shaft 113, a pair of worms 118 and 119 are fixedly mounted in meshing engagement with the additional gears 116 and 117. In this disposition, the direction of the teeth formed on the worm 118 should be opposite to that on the worm 119, that is, when the driving shaft 113 rotates, the rotating direction of the additional gear wheel 116 meshing with the worm 118 is opposite to that of the gear wheel 117 meshing with the worm 119. One end of the driving shaft 113 is connected to a given driving source (not shown).

In the above-described mechanical arrangement, when the driving shaft 113 starts to rotate, the pair of additional gear wheels 116 and 117 are rotated into opposite directions as afore-mentioned. By this rotation of the driving gear wheels 116 and 117, similar directional rotations of the shafts 101, 104 and 105 are actuated and the shafts 102, 103 and 106 are rotated into similar direction but opposite to the rotating directions of the above-mentioned shafts 101, 104 and 105.

Coming back to FIG. 14 again, the respective grouped width sections I, II and III are provided with upper blades 23, 21 and 25 secured to the respective shafts 101, 103 and 105 and with lower blades 22, 24 and 20 secured to the respective shafts 102, 104 and 106. In the condition shown in FIG. 14, the angular phase of the lower blade 24 of the group II is delayed by 60° from that of the upper blade 23 of the group I, the angular phase of the upper blade 25 of the group III is delayed by 60° from that of the lower blade 24 of the group II, the including angle between the upper blade 23 and the lower blade 22 of the group I is 180°, the angular phase of the upper blade 21 of the group II is advanced by 60° from that of the lower blade 22 of the group I and the angular phase of the lower blade 20 of the group III is advanced by 60° from that of the upper blade 21 of the group II.

In the second embodiment, as indicated in FIGS. 14, 15A and 15B, the traverse guide means is composed of pairs of oppositely rotatable, rotary blades 20, 25, 21, 24, and 22, 23 assigned to plural groups into which the full traverse stroke Wo for traversing the yarn Y is divided. Each pair of rotary blades assigned to each divided group is driven with the phase staggered for each section, as is described above.

Figure 16A:
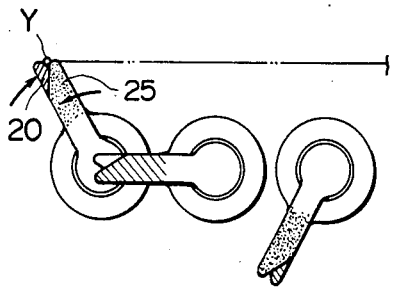
FIGS. 16A, 16B and 16C are plan views showing the guided state of a yarn utilizing the apparatus of FIG. 14.
Figure 16B:
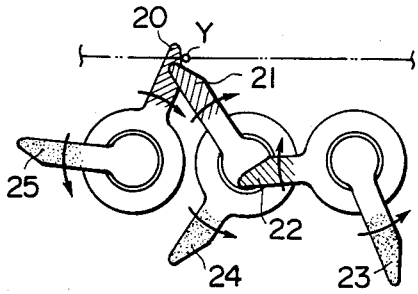
Figure 16C:
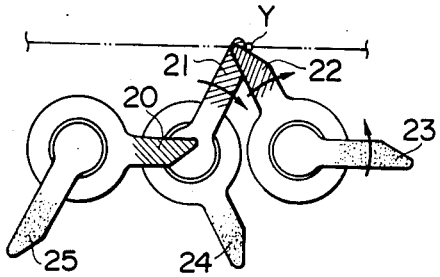

The yarn Y is guided by means of the rotary blades 20, 25, 21, 24 and 22, 23 and a wavy guide 26 which is provided along the rotating locus of the rotary blades. As shown in FIGS. 16A, 16B and 16C, the yarn is successively guided and traversed by the rotary blades 20, 25, 21, 24 and 22, 23. FIGS. 14 to 17B illustrate the case of the rotary blades being divided into three groups in the full traverse stroke Wo but the number of groups is not limited to three. The number of the groups is at least one.

In this mode of traversing too, the same excessive winding of the yarn as illustrated in FIG. 12B will take place in the package, because at turnaround of the yarn Y, the traverse speed of the yarn Y on the package drops on account of an uncontrolled length existing from the blade guide point to the package winding point.

Figure 17A:
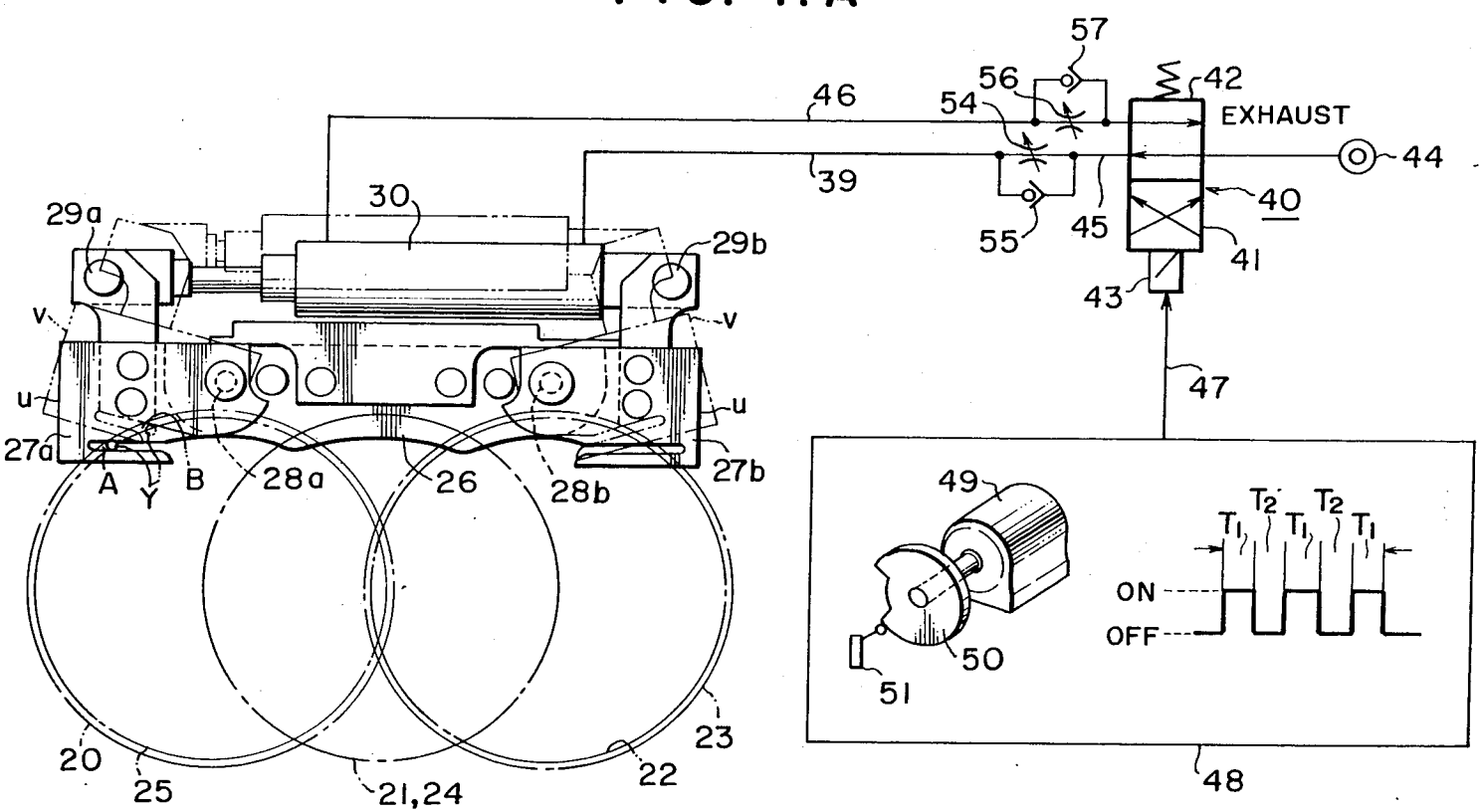
FIG. 17A is a plan view showing a yarn release guide and the vicinity thereof.
Figure 17B:
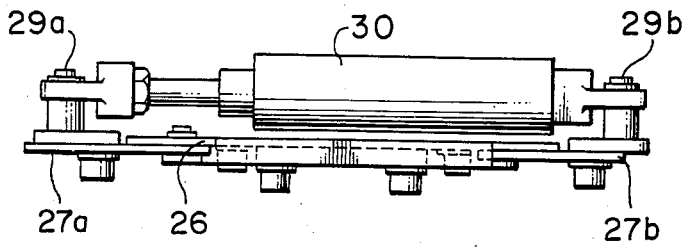
FIG. 17B is a side view of the apparatus of FIG. 17A.
Figure 20:
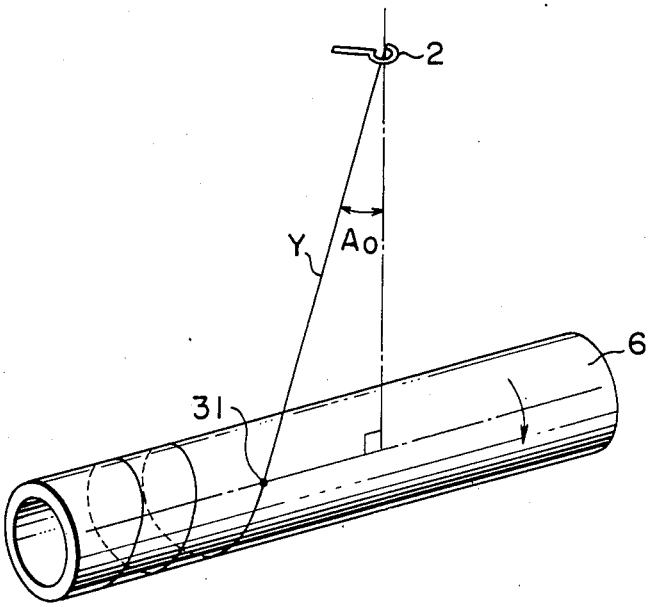
FIG. 20 is an oblique view schematically showing how a released yarn turns around toward the mid-width of a package.

For this reason, in the second embodiment of the present invention, as indicated in FIGS. 17A and 17B, yarn release guides **27*a*, 27*b* are located at both ends of wavy guide 26. These guides 27*a*, 27*b* are designed to rotate around shafts 28*a*, 28*b***.

The guides **27*a*, 27*b* are swingable around the shafts 28*a*, 28*b* by means of, say, a cylinder 30 whose rear end and rod ends are connected rotatably through shafts 29*a*, 29*b* to the yarn release guides 27*a* and 27*b*, respectively. The guides 27*a* and 27*b* can take, by swinging, two positions of the solid line position u and the two-dot chain line position v in FIG. 17A. When these guides 27*a*, 27*b* are at the position u, the turnaround point where the yarn Y is released from the rotary blades 20–25 comes at the point A in FIG. 17A and the yarn Y is traversed with the full traverse stroke Wo corresponding to the full width Wp of the yarn package 7. When these guides 27*a*, 27*b* are at the position v, the turnaround point where the yarn Y is released from the rotary blades 20–25 comes at the point B in FIG. 17A** and the yarn Y is traversed with the narrow traverse stroke W being narrower than the stroke Wo.

In the illustrated example, the pair of yarn release guides **27*a*, 27*b*** are so driven that they come at the same time into or out of the yarn path, but they can be independently driven by providing them with separate cylinders.

The cylinder 30 is actuated a plurality of times in a particular program during the winding of a single package in order to obtain the desired winding formations set out in FIGS. 21A to 21D.

The drive means, connected to the cylinder 30, for moving the yarn release guides **27*a* and 27*b* are the same as those described in the first embodiment of the present invention, and therefore the explanation about the same parts will be omitted by attaching the same reference numerals in FIGS. 7A to 7D to the same parts of FIG. 17A**. Of course, the yarn traverse strokes Wo and W and the times T1 and T2 are adjustably determined in the same manner as in the first embodiment.

Figure 18A:
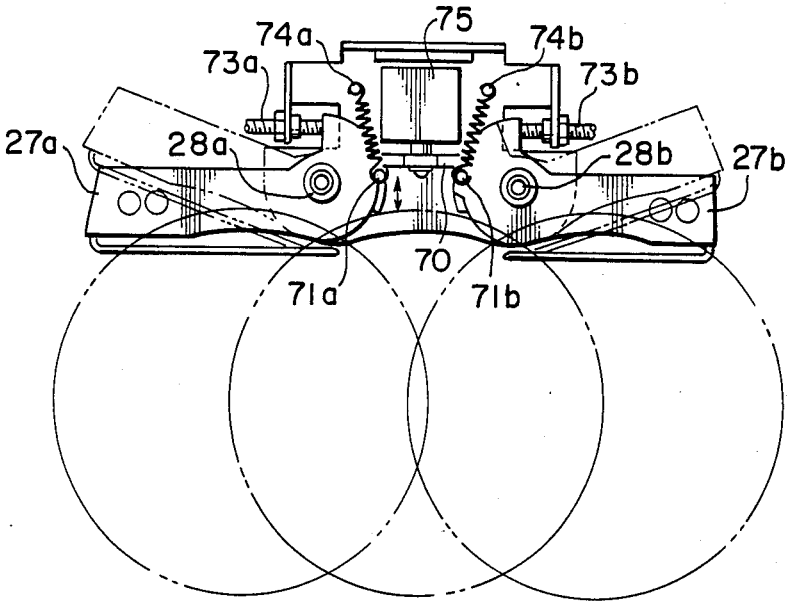
FIG. 18A is a plan view of a rotary blade traverser in which a cylinder is disposed between yarn release guides.
Figure 18B:
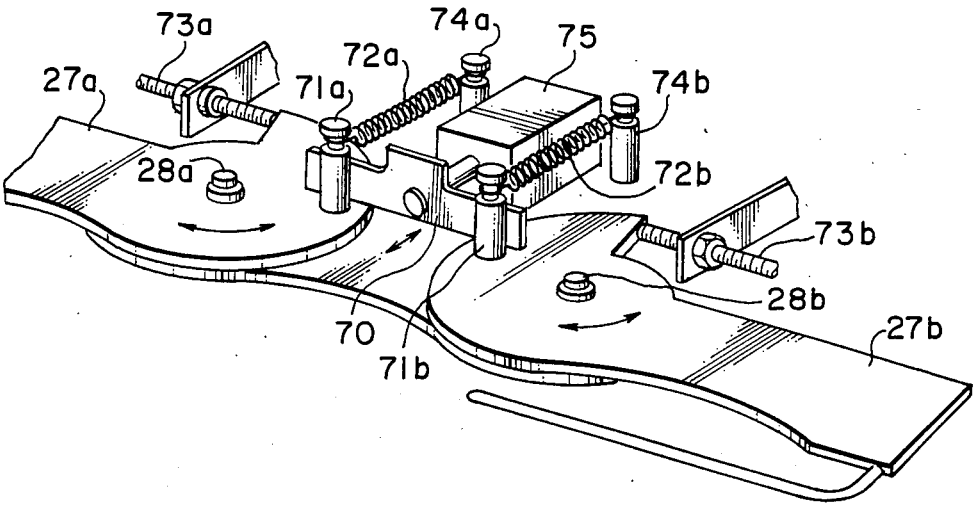
FIG. 18B is an enlarged oblique view of the rotary blade traverser of FIG. 18A.

A drive means for moving the yarn release guides **27*a* and 27*b* may be constructed as shown in FIGS. 18A and 18B. The yarn release guides 27*a* and 27*b* are rotatable around the shafts 28*a* and 28*b*. Pins 71*a* and 71*b* are fixed to the yarn release guides 27*a* and 27*b* and the pins 71*a* and 71*b* are adapted to be pushed by the push plate 70 coupled with a cylinder 75. The pins 71*a* and 71*b* are pulled by springs 72*a* and 72*b* which are provided between the pin 71*a* and fixed pin 74*a* and between the pin 71*b* and fixed pin 74*b*. Through being pushed by the cylinder 75 and being pulled by the springs 72*a* and 72*b*, the yarn release guides 27*a* and 27*b* can be rotated in normal and reverse direction. The end position of the rotation of the yarn release guides 27*a* and 27*b* is determined by stoppers 73*a* and 73*b*, whereby the narrow traverse stroke W of the yarn is determined. The drive means for operating the cylinder 75 is the same as the drive means for operating the cylinder 30 of FIG. 17A**. Therefore, the times T1 and T2 are adjustably determined.

A drive means for moving the yarn release guides may utilize an electric motor in spite of the cylinder, as mentioned in the first embodiment of the present invention.

Figure 19A:
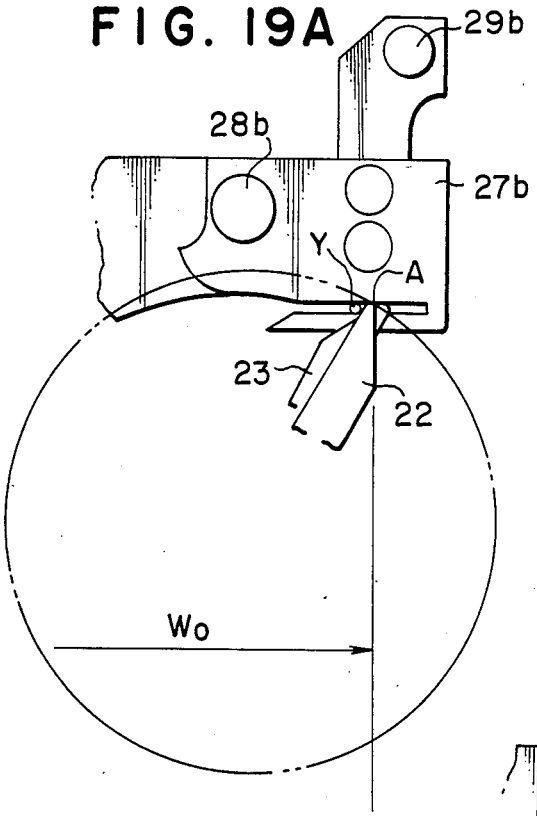
FIG. 19A is a partial plan view of the yarn release guide illustrating the release of the yarn traversed at a full traverse stroke from a rotary blade.
Figure 19B:
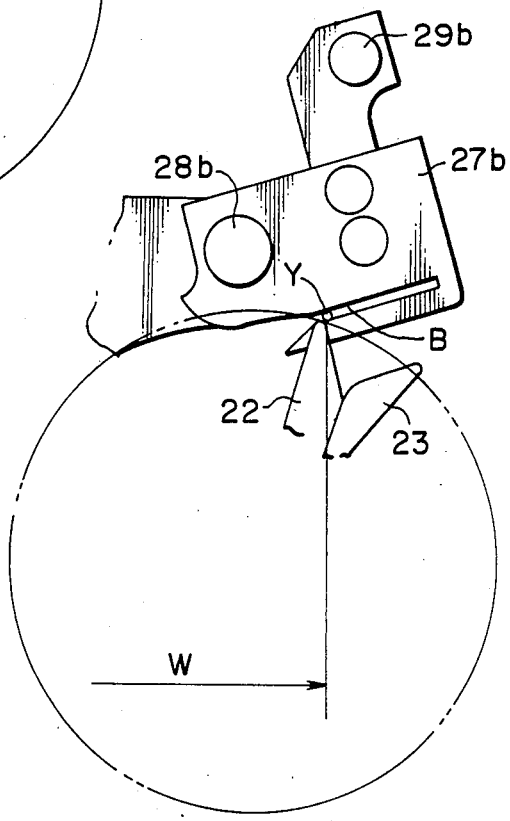
FIG. 19B is a partial plan view of the yarn release guide illustrating the release of the yarn traversed at a narrow traverse stroke from the rotary blade.

Yarn winding according to the second embodiment of the present invention is done as follows:

When the yarn release guides 27*a*, 27*b* are at the position u in FIG. 17A, the guides 27*a*, 27*b* constitute, as shown in FIG. 14, a part of the same wavy guide 26 as in the conventional device; and the yarn Y is released from the rotary blades 20–25 at the point A of FIG. 17A, i.e., at the end of the full traverse stroke Wo as shown in FIG. 19A. By contrast, when the yarn release guides 27*a*, 27*b* shift from the position u to the position v in FIG. 17A, the yarn Y is released from the rotary blade 25 at the point B of the guide 27*a* shown in two-dot chain line v of FIG. 17A and from the rotary blade 22 at the point B of the guide 27*b* shown in two-dot chain line v of FIG. 19B. Then according to the principle illustrated in FIG. 20, the yarn Y begins to return toward the mid-width of the package 7 released from the rotary blades 20–25 which have so far guided the yarn Y toward the package end.

Thereafter the rotary blades 20–25 run after the yarn Y and, catching up with the yarn Y, the blades 20–25 guides the yarn Y toward the opposite end of the package.

Due to these actions of the yarn release guides 27*a*, 27*b*, the traverse stroke of the yarn Y differs at the two positions, namely at the u, v positions in FIG. 17A, of the yarn release guides 27*a*, 27*b*. When the guides 27*a*, 27*b* are at v, the traverse stroke W is narrow. Thus, in the same way as in the case of the cam traverser, the recess of the mid-portion of the package can be covered up by swinging the guides 27*a*, 27*b* to the position v, holding them at the position for an appropriate time and thereby keeping the traverse stroke of the yarn Y, narrow.

Through alternation of the time T1 in which the yarn Y, held by the rotary blades 20–25 which constitute the traverse guide means, is repeatedly traversed over the full traverse stroke Wo corresponding to the full width Wp of the package 7 and the time T2 in which the yarn Y, released from the rotary blades 20–25, is repeatedly traversed over the narrow traverse stroke W narrower than the stroke Wo, a yarn package with an even hardness of winding can be produced.

It should be noted that T1 and T2, as illustrated in FIGS. 21A, 21B, 21C and 21D, may be alternated regularly or may be alternated irregularly, just as in the first embodiment of the present invention.

The ratio of the sum of every time T1 during the package formation period to the sum of every time T2 during the package formation period is desirably set in the range between 3 and 30, more desirably between 8 and 20, just as in the first embodiment.

Also it should be noted that the narrow traverse stroke W may be constant as in FIGS. 21A, 21B and 21D or may be varied as in FIG. 21C, just as in the first embodiment.

As easily understood from the above description, the present invention can be easily applied to a high-speed rotary blade traverser with slight modifications in design.

Although only a few exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention as defined in the following claims.

What is claimed is:

1. A yarn winding apparatus comprising:

a bobbin for taking up yarn supplied from a yarn source;

drive means for rotating said bobbin about a rotational axis;

a stationary yarn guide through which the yarn moves between the yarn source and the bobbin;

yarn traverse guide means for guiding the yarn in a direction substantially parallel to the rotational axis of said bobbin, said yarn traverse guide means being positioned between said stationary yarn guide and said bobbin;

drive means for reciprocably driving said yarn traverse guide means along a stroke width between two ends of the stroke width;

first and second yarn release guides, said first yarn release guide being located inside of the stroke width and in the vicinity of one end of the stroke width, said second yarn release guide being located inside of the stroke width and in the vicinity of the other end of the stroke width;

means for mounting said yarn release guides for movement into and out of a yarn path between the stationary yarn guide and the bobbin, and for enabling one of said yarn release guides to engage and disengage the yarn, said yarn being released from the yarn traverse guide means where the yarn intercepts one of the yarn release guides in the yarn path, said yarn being recaptured by the yarn traverse guide means after said yarn traverse guide means move out of the yarn path whereby the yarn is again guided by said yarn traverse guide means; and drive means for moving the yarn release guides into and out of the yarn path;

2. The yarn winding apparatus of claim 1 wherein said drive means for moving said yarn release guides comprises:

a. a cylinder mechanically connected to said yarn release guides so that a reciprocating motion of said cylinder corresponds to the movement of said yarn release guides into or out of said path of the yarn;

b. a pneumatic solenoid valve being provided in an air-circuit for supplying a pressurized air to said cylinder and exhausting said air from said cylinder;

c. an electric controller electrically connected to said pneumatic solenoid valve, said electric controller having means for determining times of ON and OFF of said pneumatic solenoid valve; and d. a stopper for adjustably determining one end position of a stroke of said cylinder which determines said narrow stroke W.

3. The yarn winding apparatus of claim 1 wherein said drive means for moving said yarn release guides comprises:

a. an electric motor mechanically connected to said yarn release guides so that a rotation of said motor in a normal or reverse direction corresponds to the movement of said yarn release guides into or out of said path of the yarn;

b. a stopper for adjustably determining a range of the rotation of said motor; and c. a timer for determining times in which the rotation of said motor stops at respective ends of said range of the rotation of said motor.

4. The yarn winding apparatus of claim 1 wherein said traverse guide means comprises a traverse guide having a groove capable of freely catching and releasing the yarn and wherein said drive means for driving the traverse guide means comprises a cylindrical barrel cam having a spiral cam groove in the surface with which said traverse guide slidably engages.

5. The yarn winding apparatus of claim 4 wherein said cam groove is formed as a smooth arc at both ends of the cylindrical cam barrel.

6. The yarn winding apparatus of claim 4 wherein the drive means for the yarn release guides cause said guides to travel, at the same time, into or out of the path of the yarn.

7. The yarn winding apparatus of claim 4 wherein the drive means for the yarn release guides cause said guides to travel into or out of the path of the yarn in a direction normal to a yarn traverse direction.

8. The yarn winding apparatus of claim 4 wherein the drive means for the yarn release guides cause said guides to travel into or out of the path of the yarn in a yarn traversing direction.

9. The yarn winding apparatus of claim 4 wherein the traverse guide is provided with a yarn catcher having a groove which freely catches or releases said yarn and symmetric slopes capable of easily introducing the yarn into said groove on both sides of said groove.

10. The yarn winding apparatus of claim 9 wherein an angle made by each of said slopes and the center line of said traverse guide is in the range of 30°–60°.

11. The yarn winding apparatus of claim 10 wherein the angle is in the range of 42°–48°.

12. The yarn winding apparatus of claim 1 wherein the yarn traverse guide means comprise at least a first and second pair of oppositely rotating rotary blades said at least a first and second pair divide the stroke width into a corresponding number of sections.

13. The yarn winding apparatus of claim 12 wherein the drive means for the yarn traverse guide means includes means for driving the first of the at least said first and second pair of rotary blades at a different phase than the second of said at least said first and second pair of rotary blades.

14. The yarn winding apparatus of claim 12 further comprising a wavy guide having a first and second end and having indentations provided for each of said at least a first and second pair of rotary blades, said first yarn release guide being swingably mounted at the first end of the wavy guide, said second yarn release guide being swingably mounted at the second end of said wavy guide, and said drive means for moving the yarn release guide swinging said first and second yarn release guides into and out of the yarn path.

15. The yarn winding apparatus of claim 12 wherein the first and second yarn release guides are simultaneously driven by said drive means for moving the yarn release guides.

16. The yarn winding apparatus of claim 3 wherein said traverse guide means comprises a traverse guide having a groove capable of freely catching and releasing the yarn and wherein said drive for driving the traverse guide means comprises a cylindrical barrel cam having a spiral cam groove in the surface with which said traverse guide slidably engages.

17. The yarn winding apparatus of claim 3 wherein the yarn traverse guide means comprises a pair of oppositely rotating rotary blades provided in each one of the plural sections into which the full traverse stroke Wo is divided.

18. The yarn winding apparatus of claim 1 wherein the yarn is free from control of the yarn traverse guide means when the yarn is released from the yarn traverse guide means.

* * * * *